US007031490B2

(12) United States Patent
Stompler

(10) Patent No.: US 7,031,490 B2
(45) Date of Patent: Apr. 18, 2006

(54) SPEAKER DRIVER WITH DETACHABLE MOTOR AND BASKET

(75) Inventor: Thilo Christian Stompler, San Diego, CA (US)

(73) Assignee: T C Sounds Inc., San Diego, CA (US)

( * ) Notice: Subject to any disclaimer, the term of this patent is extended or adjusted under 35 U.S.C. 154(b) by 20 days.

(21) Appl. No.: 10/395,765

(22) Filed: Mar. 24, 2003

(65) Prior Publication Data

US 2003/0219142 A1 Nov. 27, 2003

Related U.S. Application Data

(60) Provisional application No. 60/367,659, filed on Mar. 26, 2002, provisional application No. 60/367,584, filed on Mar. 26, 2002.

(51) Int. Cl.
*H04R 25/00* (2006.01)

(52) U.S. Cl. ..... 381/433; 381/412; 381/396

(58) Field of Classification Search ..... 381/87, 381/332, 396, 412–416, 419–420, 433, 386, 381/395, 389, 86
See application file for complete search history.

(56) References Cited

U.S. PATENT DOCUMENTS

| | | | | | |
|---|---|---|---|---|---|
| 2,501,032 | A * | 3/1950 | Harbaugh | ..... | 381/420 |
| 3,356,796 | A * | 12/1967 | Wray | ..... | 381/433 |
| 3,413,579 | A * | 11/1968 | Sloan | ..... | 335/231 |
| 4,234,766 | A * | 11/1980 | Cacho | ..... | 381/394 |
| 4,508,941 | A * | 4/1985 | Wiggins | ..... | 381/405 |
| 4,580,015 | A * | 4/1986 | O'Neill | ..... | 381/396 |
| 6,219,431 | B1 * | 4/2001 | Proni | ..... | 381/397 |
| 6,229,902 | B1 * | 5/2001 | Proni | ..... | 381/400 |

* cited by examiner

*Primary Examiner*—Sinh Tran
*Assistant Examiner*—Phylesha Dabney
(74) *Attorney, Agent, or Firm*—Michael W. Landry

(57) ABSTRACT

A speaker driver has a detachable motor and basket to allow attachment or separation of the motor assembly from the basket assembly. Two embodiments are disclosed, a thread-on detachable motor and a bolt-on detachable motor.

1 Claim, 14 Drawing Sheets

SPEAKER DRIVER WITH DETACHABLE MOTOR AND BASKET

RELATED APPLICATIONS

This application claims priority to U.S. provisional patent application No. 60/367,659 filed Mar. 26, 2002 entitled "Detachable speaker driver with bolt on motor" and U.S. provisional patent application No. 60/367,584 filed Mar. 26, 2002 entitled "Detachable speaker driver with screw on motor"

BACKGROUND

Speaker drivers convert an electrical signal to sound by inducing a current in a voice coil that is within a permanent magnetic field. The magnetic field produced by the voice coil current interacts with the permanent magnet field and causes movement of the voice coil. The voice coil is wound around a voice coil former and is attached to a cone which causes air movement and sound to propagate. A basket provides a frame to support the large diameter of the cone through a flexible surround. The former attached at the small end of the cone is stabilized by a spider, which allows movement along the axis of the cone and voice coil and restrains lateral motion.

Drivers are produced in a range of sizes. The smallest, a tweeter, is used for reproducing the high frequency end of the audio range. A midrange driver is used for reproducing the mid range of the audio spectrum. A woofer driver is used for the lower end of the audio spectrum. At the extreme low end of the audible range, and below, a sub-woofer driver is used. At lower audio frequencies more air volume needs to be moved. This requires a larger cone and a higher displacement in the motion of the cone. In order to move a large volume of air with a speaker driver mounted in a small enclosure, a large permanent magnet is needed and a high voice coil current.

The permanent magnet, T-yoke, and gap plate are referred to as the motor. In a conventional speaker driver, the motor is attached to the basket using screws that are inserted from inside the basket, underneath the cone, passing through holes in the basket and threading into the gap plate. Once the surround is attached to the basket, the removal of the motor is prevented because the attachment screws are no longer accessible. This arrangement dictates a specific sequence in manufacturing, where the motor must be attached to the basket prior to the voice coil, cone, and surround being assembled.

U.S. Pat. No. 4,234,766 "speaker assembly" issued to Cacho describes a speaker assembly with a detachable cone unit that may be removed from a base and replaced with a larger or smaller capacity speaker. This disclosure is directed to a small speaker and does not address the problem of removing the motor portion of the speaker driver from the basket after assembly. The detachable cone unit is a complete speaker driver including a cone, coil, and magnet.

Large drivers present manufacturing, shipping, and installation difficulties due to the heavy product. The cost is higher due to the large components. A substantial portion of the weight of the driver is represented by the motor. When damage occurs to the surround, cone, voice coil, or spider the driver must be shipped to a repair facility for replacement of the damaged parts.

SUMMARY OF THE INVENTION

A speaker driver has a detachable basket assembly and detachable motor assembly to allow attachment or separation of the motor from the basket after assembly of the completed driver. The basket and motor have corresponding attachment mechanisms that are engaged with each other to complete assembly of the speaker driver. This arrangement facilitates separate manufacturing of the motor and basket assemblies, either at two facilities or on two production lines. The detachable arrangement enables easier repair of a damaged driver, either during manufacture of the driver or a returned product. Reduced shipping costs are possible because a driver can be separated and the only section needing repair or replacement is shipped.

In one embodiment of the detachable driver, the motor is attached to the basket using a basket mounting ring attached to the basket and secured using externally accessible screws. The screws pass through holes in the basket mounting ring and thread into the gap plate.

In another embodiment of the detachable driver, the motor has a threaded member that engages a threaded section of the basket. The motor is rotated to screw it into the basket. Locking threads, thread locking liquid such as Loctite®, set screws, or elastomer locking ring can be used to prevent unintentional unthreading of the motor. The basket and gap plate can be manufactured with threaded sections, or an adapter plate with threads can be attached to the respective pieces to create the threaded mating regions.

Both embodiments of the detachable driver allow the motor and the basket to be produced as separate sub-assemblies and to be attached together into a complete speaker driver and to be detached from each other.

DETAILED DESCRIPTION OF THE INVENTION

First Embodiment, Bolt-on Detachable Motor

Figure 1:
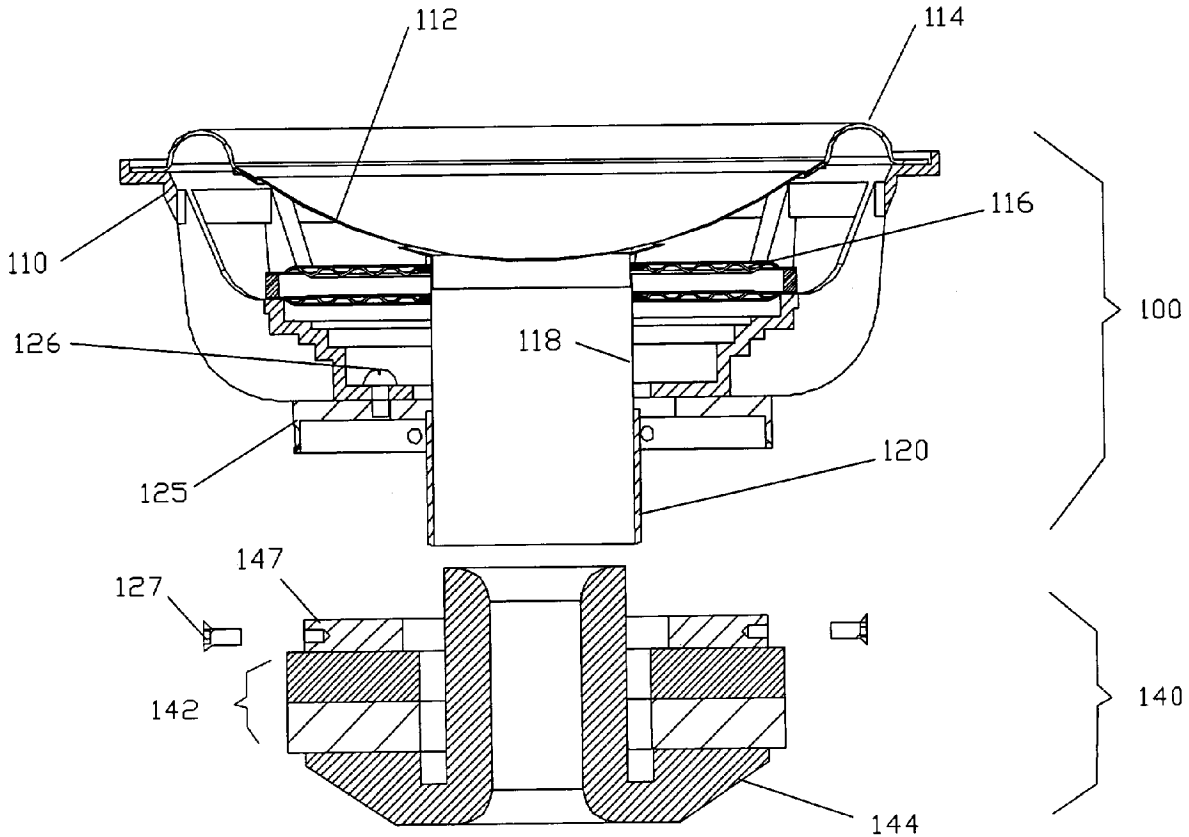
FIG. 1 shows a cross sectional view of the bolt-on detachable driver with the motor detached.

Referring to FIG. 1, a cross sectional view, basket assembly 100 is comprised of basket 110, cone 112 attached to basket 110 through surround 114, voice coil former 118 around which voice coil 120 is wound, spider 116, and basket mounting ring 125. Spider 116 and surround 114 allow cone 112 and voice coil former 118 to move in and out while providing lateral support and alignment. Basket mounting ring 125 can be attached to basket 110 with screws 126. Other configurations of attachment of mounting ring 125 to basket 110 are possible using screws or welding. Alternatively basket mounting ring 125 can be an integral part of basket 110, formed as a single molded or machined part. Basket mounting ring 125 has an overhanging region. The basket can be formed by casting, machining, or a combination of casting and machining.

Motor 140 is comprised of T-yoke 144, magnet 142, and gap plate 147, which has internal threaded holes. When assembled, coil 120 develops a force, that is transferred to voice coil former 118 and cone 112, resulting from the interaction of signal current flowing through coil 120 and the magnetic field of magnet 142.

Motor 140 is attached to basket assembly 100 by engaging gap plate 147 with basket mounting ring 125 and securing with screws 127, which pass through basket mounting ring 125 overhanging region and enter threaded holes in gap plate 147. A bolt is another name for a screw, both being described as a fastening rod with external threads and having a head used for applying rotating force to engage the threads into an internally threaded object.

Figure 2:
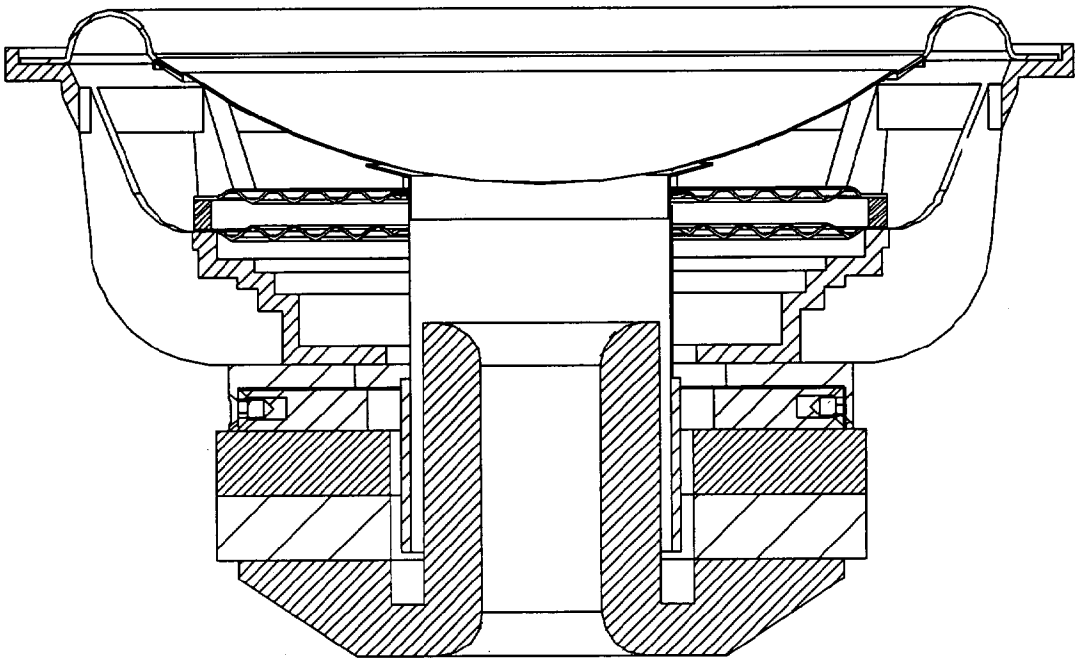
FIG. 2 shows a cross sectional view of the assembled driver.
Figure 3:
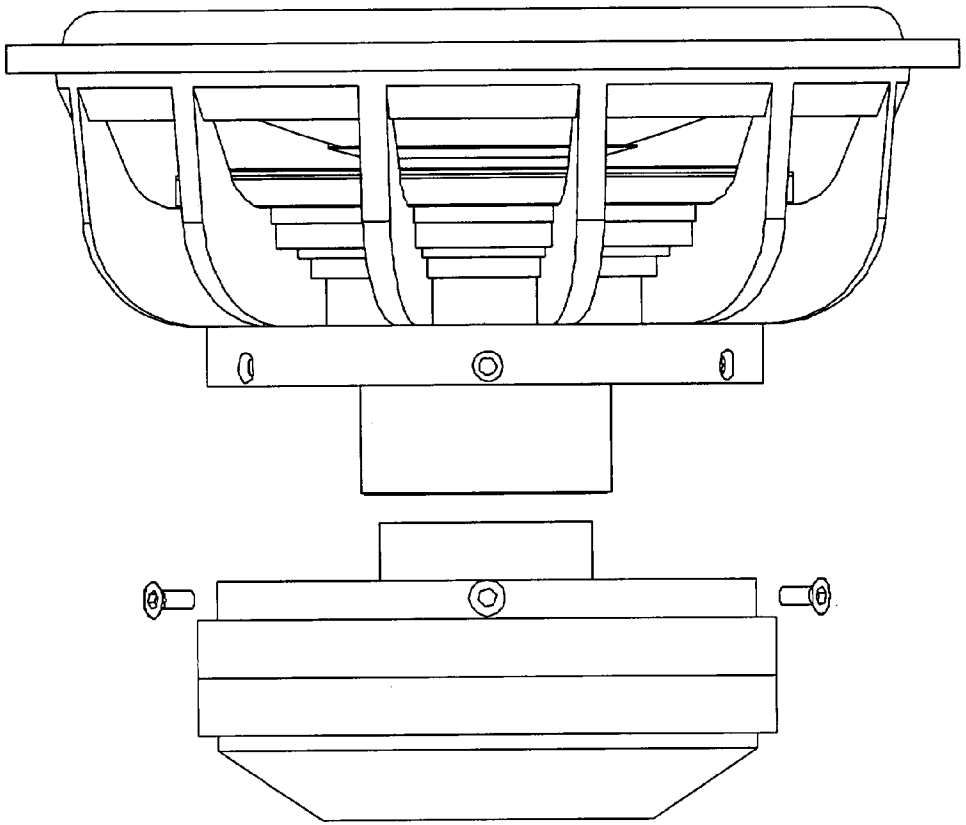
FIG. 3 shows an exterior side view of the bolt-on detachable driver.
Figure 4:
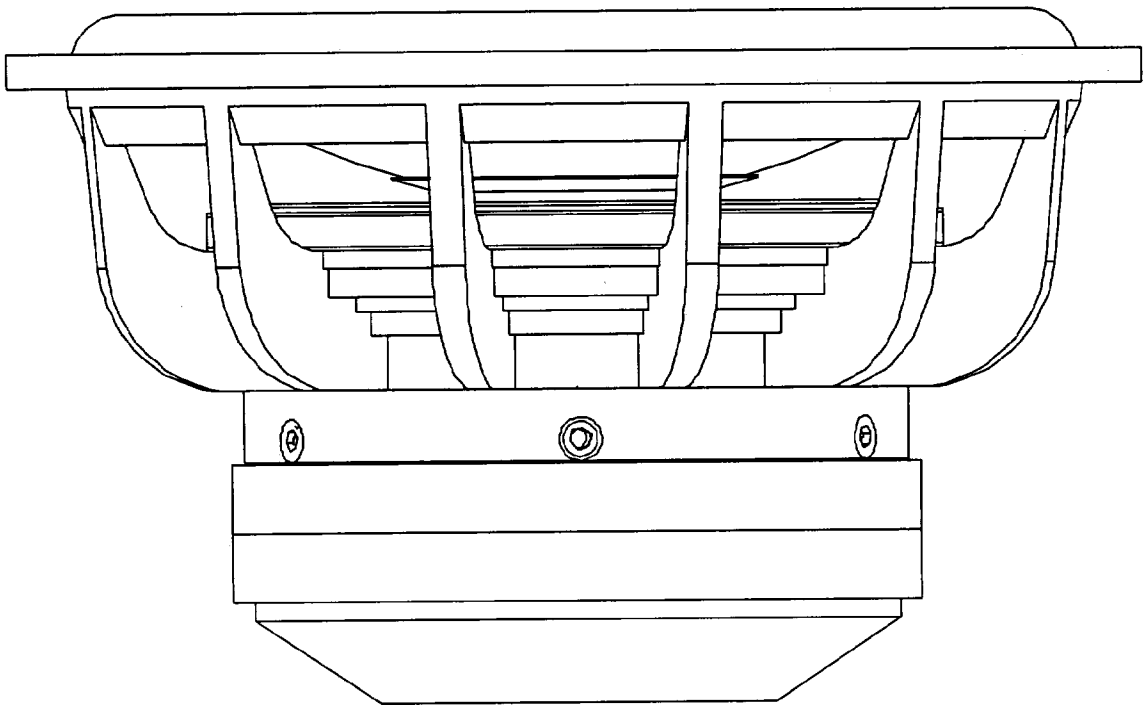
FIG. 4 shows an exterior side view of the assembled driver.

FIG. 2 shows a cross sectional view of the assembled speaker driver. FIG. 3 shows an exterior view of the motor and basket assembly prior to attachment. FIG. 4 shows an exterior view of the assembled speaker driver.

Figure 5:
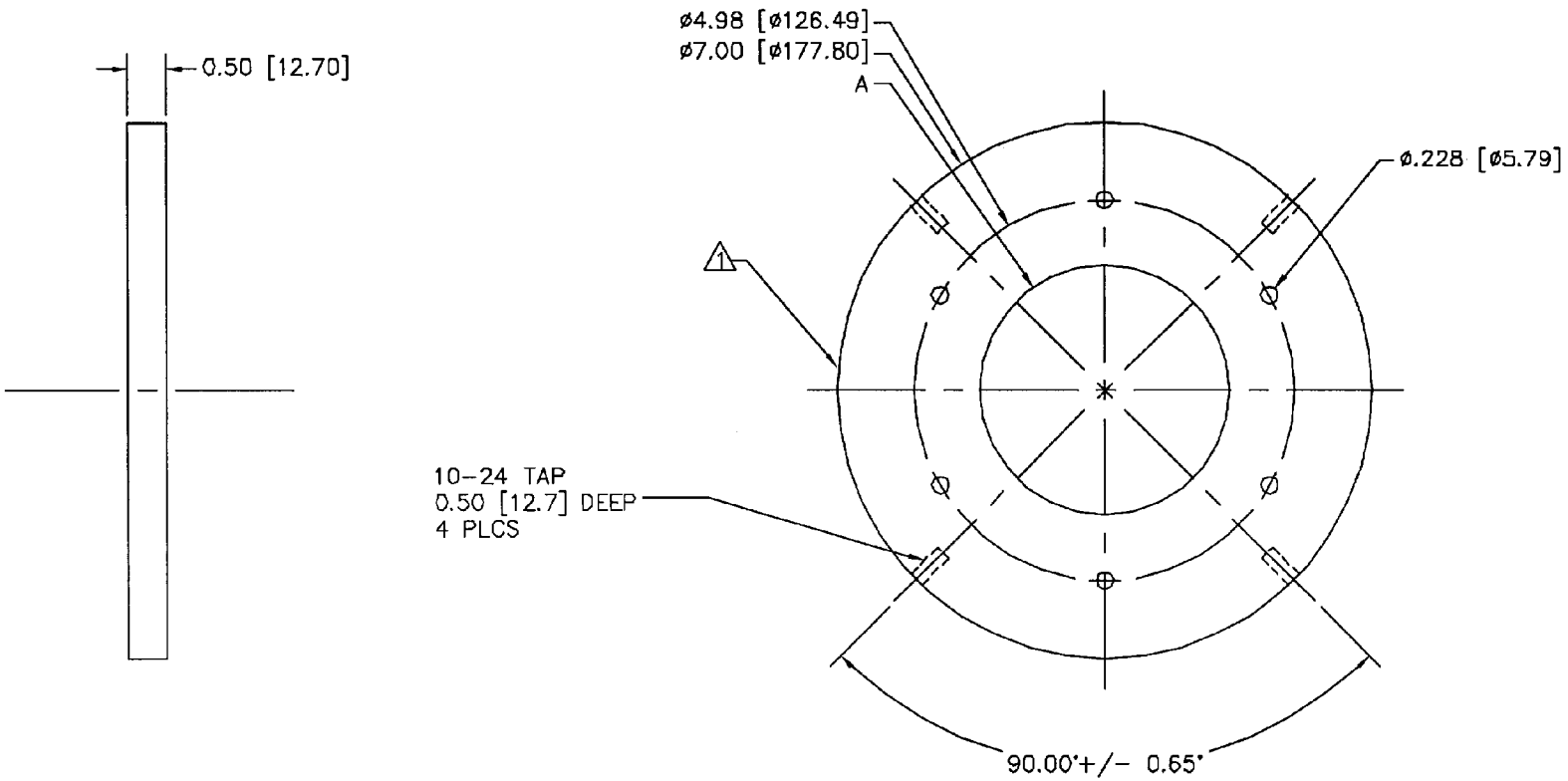
FIG. 5 shows a gap plate for use with a detachable motor.
Figure 6:
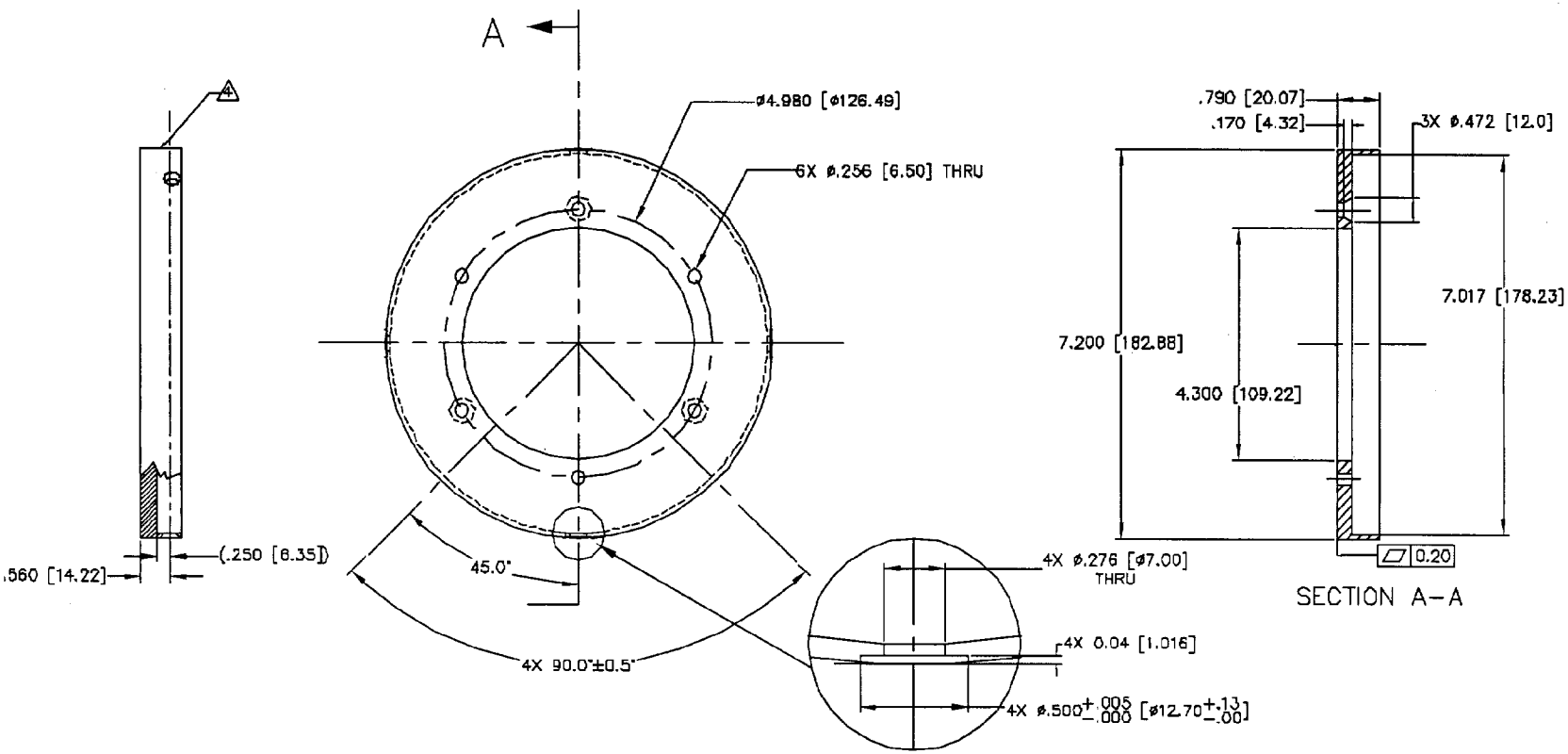
FIG. 6 shows a basket mounting ring for use with a detachable basket.

FIG. 5 shows details of a gap plate with radially positioned internally threaded holes. FIG. 6 shows details of a basket mounting ring.

In an alternative design, gap plate 147 can be formed with an overhang region and basket mounting ring 125 can be formed with internal threaded holes.

Second Embodiment, Thread-on Detachable Motor

Figure 7:
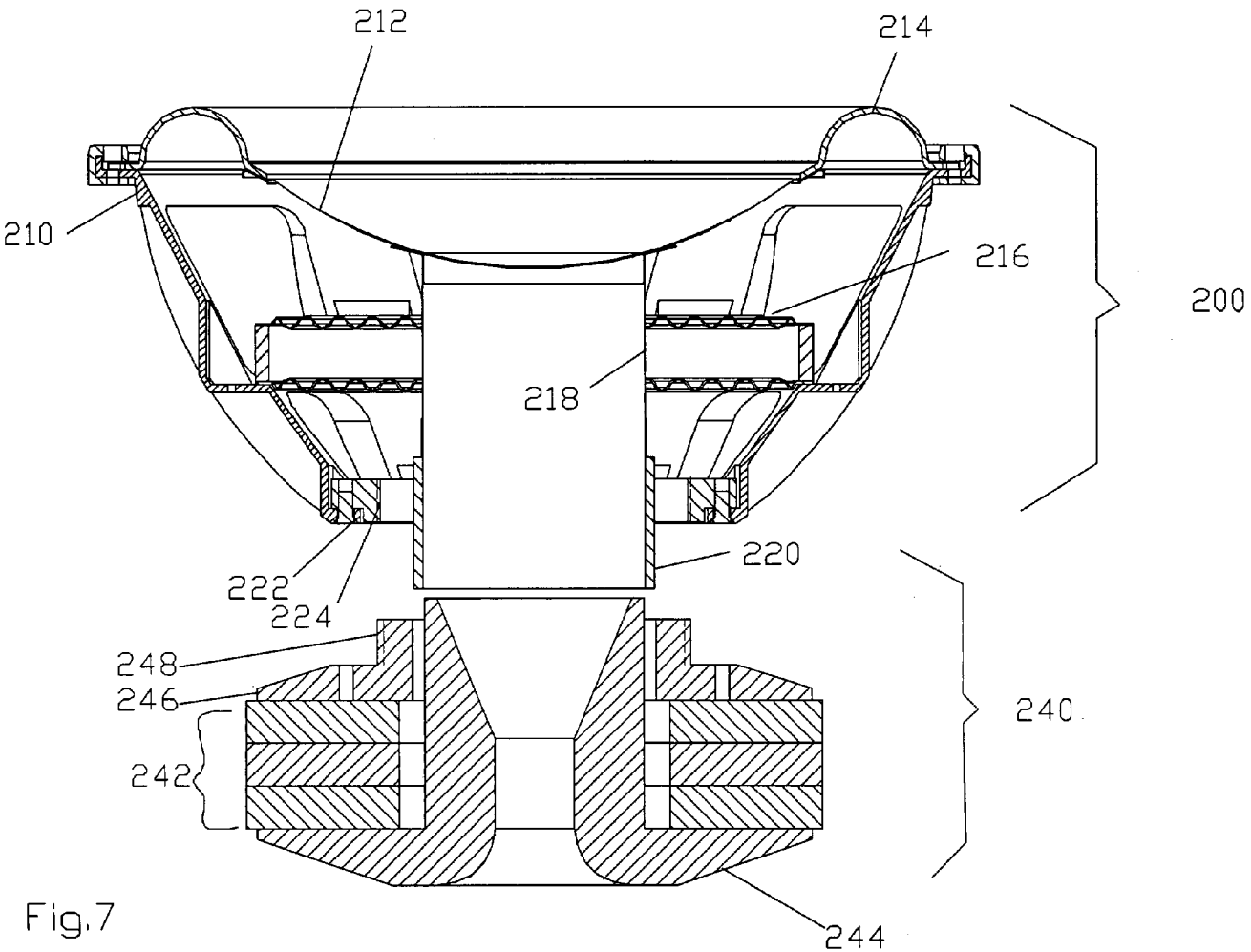
FIG. 7 shows a cross sectional view of the thread-on detachable driver with the motor detached.

Referring to FIG. 7, a cross sectional view, basket assembly 200 is comprised of basket 210, cone 212 attached to basket 210 through surround 214, voice coil former 218 around which voice coil 220 is wound, spider 216, and basket mounting ring 222. Spider 216 and surround 214 allow cone 212 and voice coil former 218 to move in and out while providing lateral support and alignment. Basket mounting ring 222 can be attached to basket 210 using adhesive or mechanical attachment devices such as screws or welding. Alternatively basket mounting ring 222 can be an integral part of basket 210, formed as a single molded or machined part. Basket mounting ring 222 has threaded region 224, which are internal threads. The threads are coaxial to the axis through the center of the speaker driver. The basket can be formed by casting, machining, or a combination of casting and machining.

Motor 240 is comprised of T-yoke 244, magnet 242, and gap plate 246, which has threaded region 248. When assembled, coil 220 develops a force, that is transferred to voice coil former 218 and cone 212, resulting from the interaction of signal current flowing through coil 220 and the magnetic field of magnet 242.

Motor 240 is attached to basket assembly 200 by engaging threaded region 248 with threaded region 224 and rotating Motor 240 relative to basket assembly 200. Set screws, locking threads, or thread locking compound can be used to prevent unscrewing of motor 240.

Figure 8:
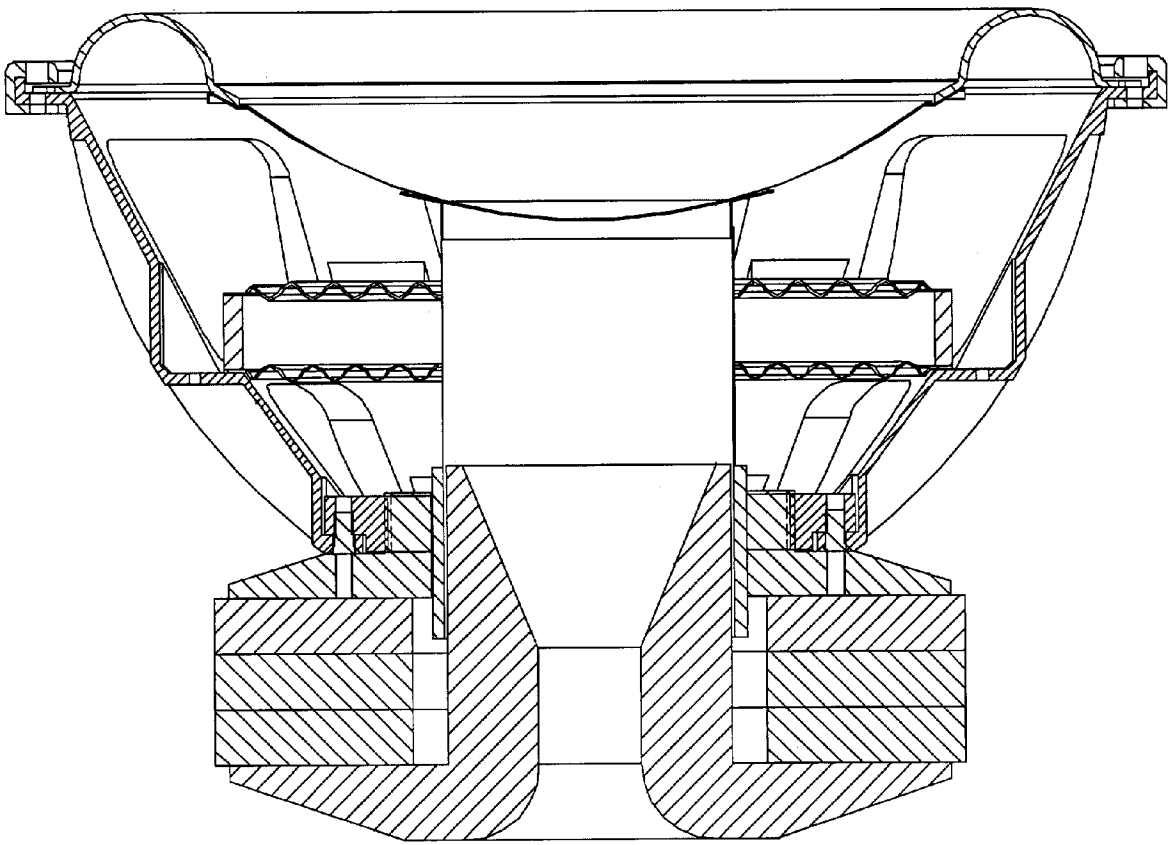
FIG. 8 shows a cross sectional view of the assembled driver.
Figure 9:
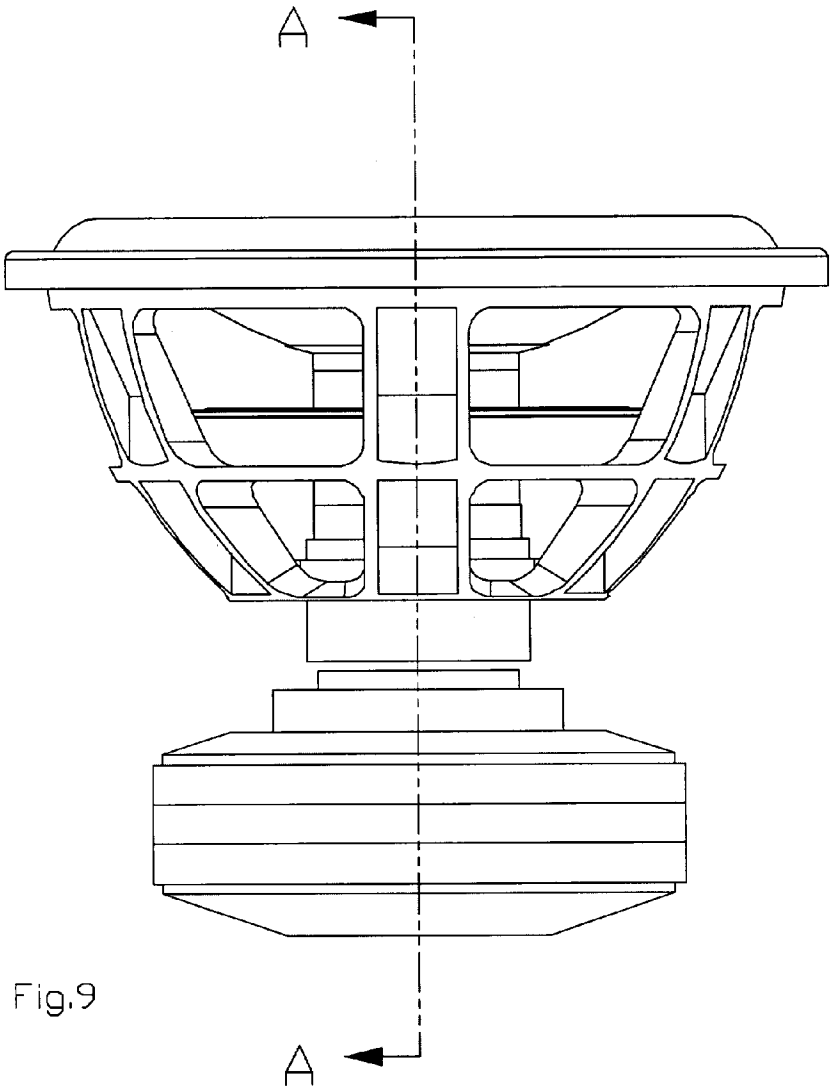
FIG. 9 shows an exterior side view of the detachable driver.
Figure 10:
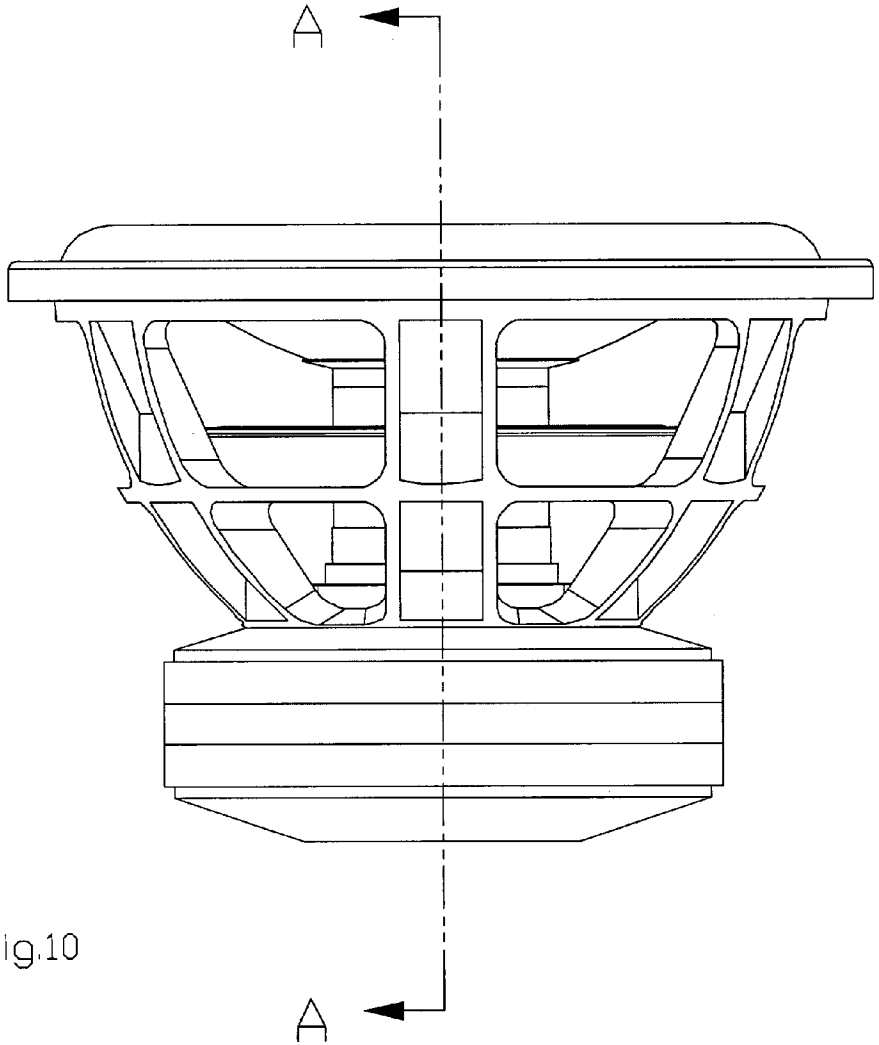
FIG. 10 shows an exterior side view of the assembled driver.

FIG. 8 shows a cross sectional view of the assembled thread-on speaker driver. FIG. 9 shows an exterior view of the motor and basket assembly prior to attachment. FIG. 10 shows an exterior view of the assembled speaker driver.

Figure 11:
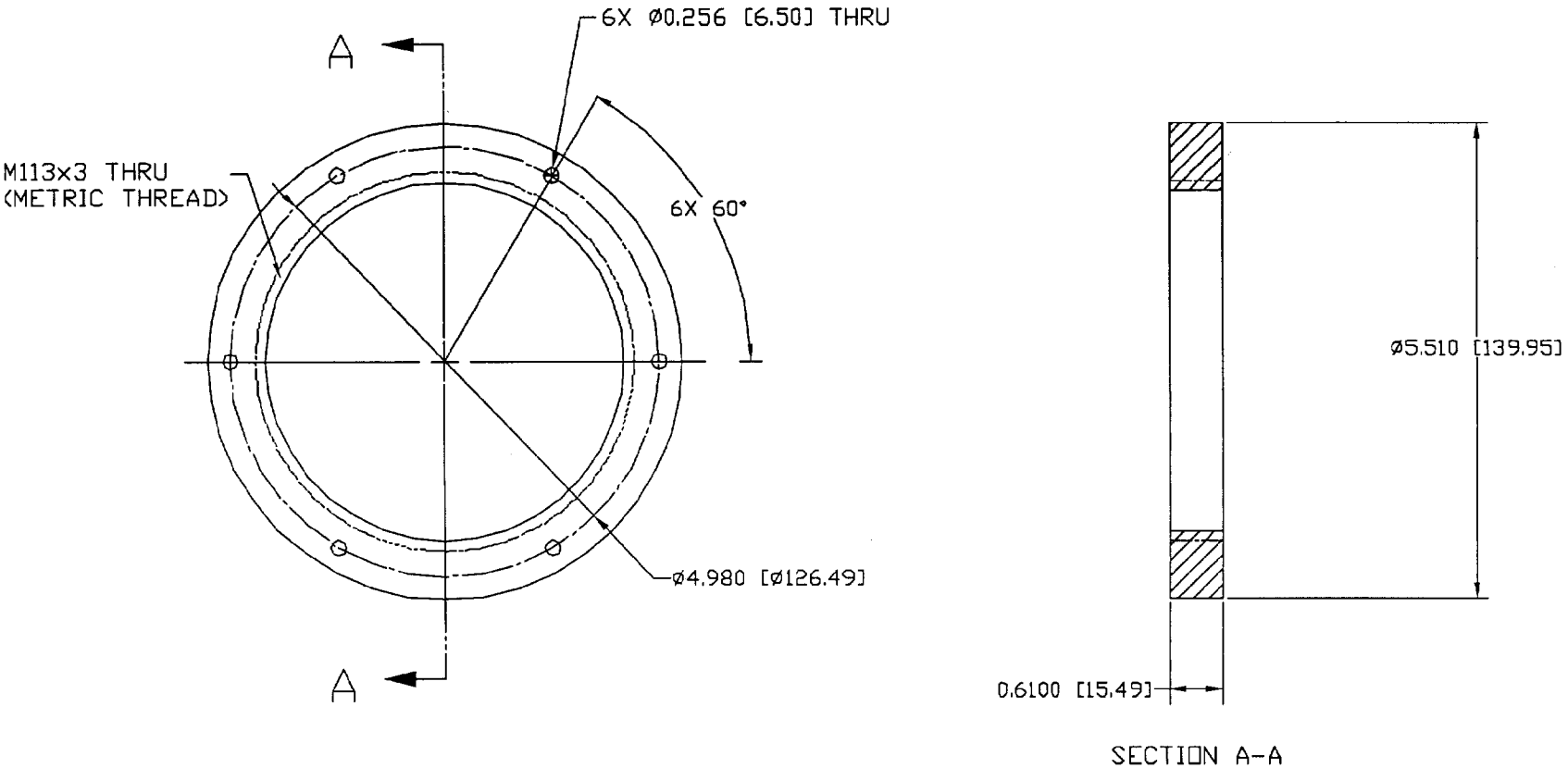
FIG. 11 shows a basket mounting ring for use with a thread-on detachable basket.
Figure 12:
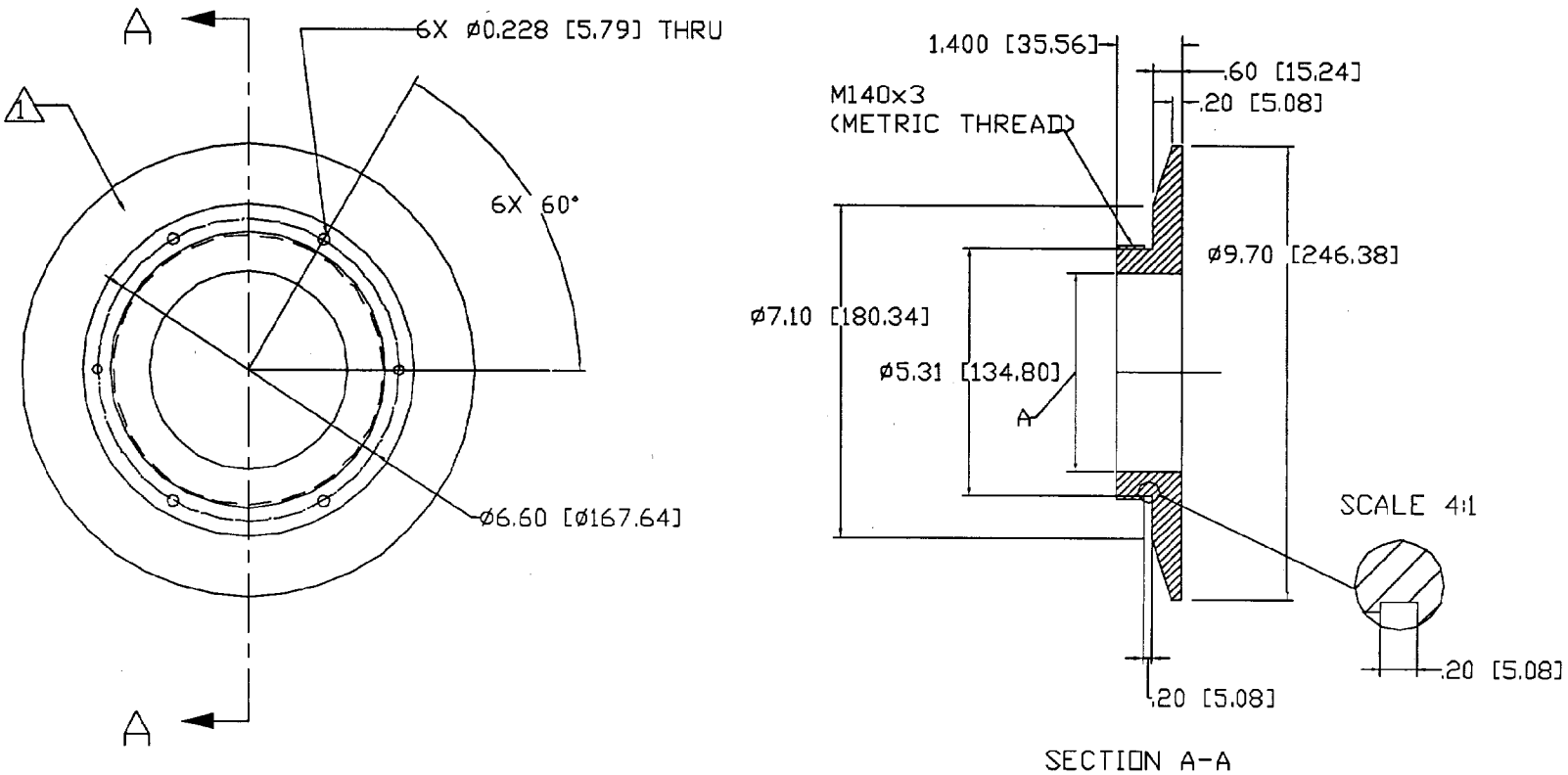
FIG. 12 shows a gap plate for use with a thread-on detachable motor.

FIG. 11 shows details of a basket mounting ring. FIG. 12 shows details of a gap plate.

Figure 13:
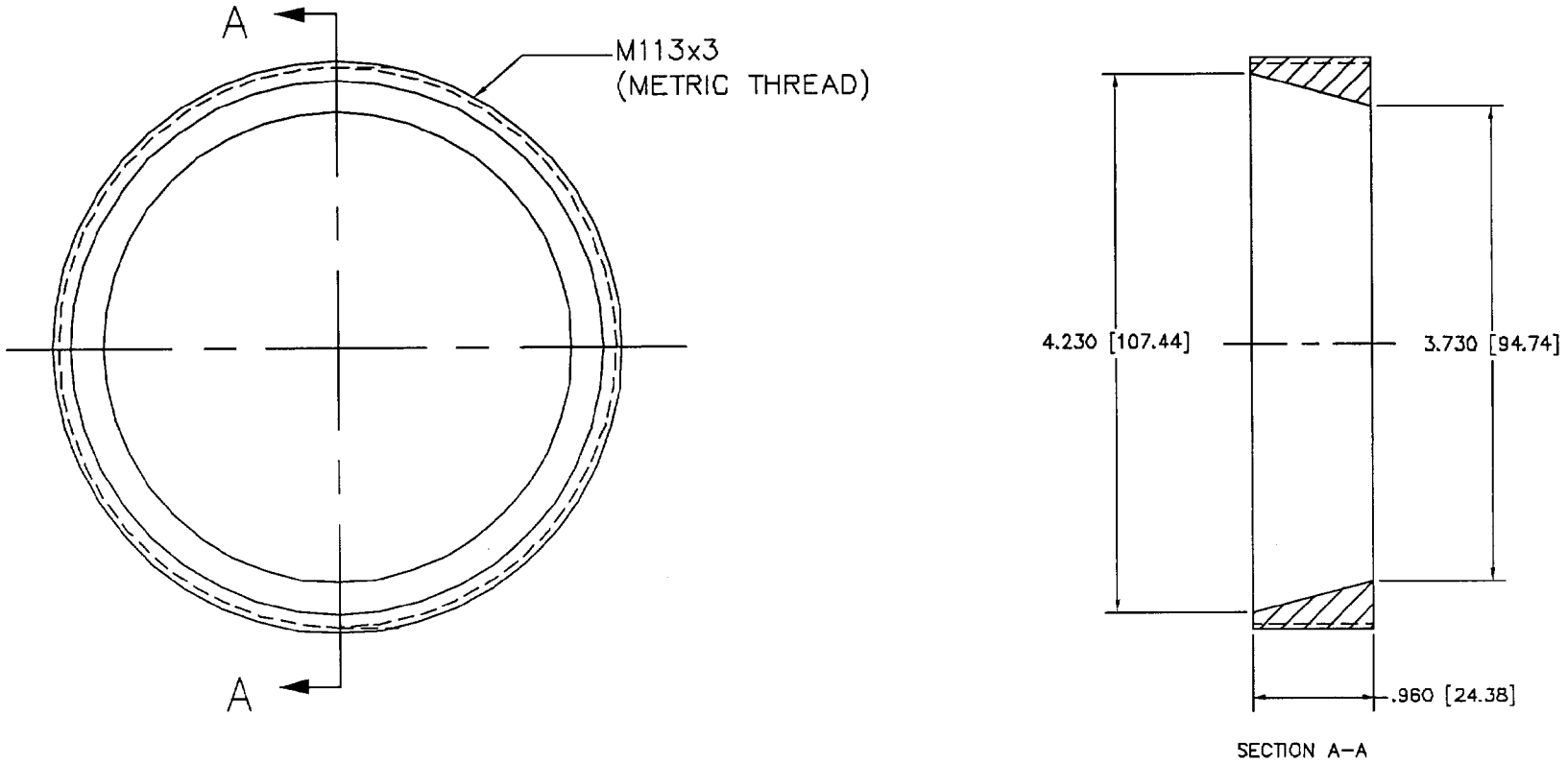
FIG. 13 shows an alternate basket mounting ring.

FIG. 13 shows an alternate basket mounting ring for assemble with a basket.

Figure 14:
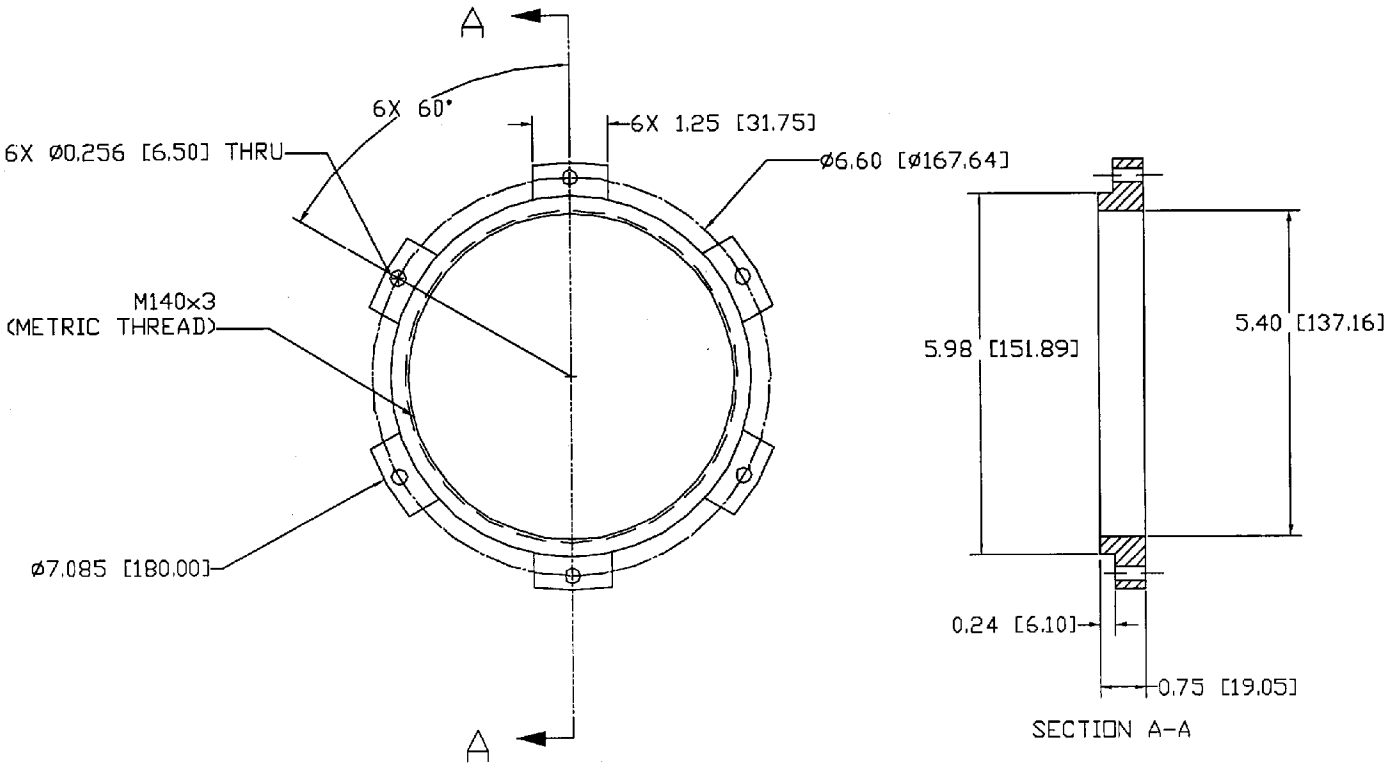
FIG. 14 shows a gap plate adaptor to adapt a gap plate without threads to use in accordance with the present invention.

FIG. 14 shows a gap plate adaptor to adapt a gap plate without threads to use in accordance with the present invention.

FIG. 12 shows detail of a gap plate with a threaded region, with M140×3 metric threading (140 mm diameter with a thread pitch of 3 mm) over an approximately 15 mm region. This results in a thread engagement of up to approximately 5 threads. FIG. 14 shows a gap plate adaptor with a threaded region of 6.10 mm, providing at least 2 full threads.

FIG. 11 and FIG. 13 show detail of mounting rings with threaded regions of 15.49 mm and 24.38 mm, respectively, to provide thread engagement of at least approximately 5 threads at a pitch shown of 3 mm.

What is claimed is:

1. A speaker driver with a detachable motor and basket comprising:

a motor assembly comprising:

a gap plate with a plurality of radially positioned threaded holes;

a permanent magnet attached to the gap plate; and a T-yoke attached to the magnet; and a basket assembly comprising:

a voice coil and voice coil former, the voice coil wound around the voice coil former;

a cone attached to the voice coil former;

a surround attached to the cone;

a basket attached to the surround and supporting the surround;

a spider attached between the voice coil former and the basket; and a basket mounting ring attached to the basket, the basket mounting ring having an overhanging region adapted to receive the gap plate and a plurality of through-holes corresponding to the gap plate threaded holes;

wherein the motor assembly attaches to the basket assembly by mating the gap plate of the motor assembly to the basket mounting ring of the basket assembly and securing with externally accessible screws that pass through the overhanging region and thread into the gap plate.

* * * * *